United States Patent [19]

Hunter

[11] Patent Number: 4,801,027

[45] Date of Patent: Jan. 31, 1989

[54] DRINKING CUP WITH TEAT ATTACHMENT

[75] Inventor: Murray Hunter, Balmain, Australia

[73] Assignee: Jackel International Pty. Ltd., New South Wales, Australia

[21] Appl. No.: 24,444

[22] Filed: Mar. 11, 1987

[30] Foreign Application Priority Data

Mar. 11, 1986 [AU] Australia ..... PH4965

[51] Int. Cl.[4] ..... A47G 19/22; A61J 9/00; A61J 11/04

[52] U.S. Cl. ..... 215/11.1; 215/100 R; 220/90.2

[58] Field of Search ..... 215/11 R, 100 R, 228, 215/11.1, 11.4, 11.5; 220/90.2, 90.4, 90.6

[56] References Cited

U.S. PATENT DOCUMENTS

| | | | |
|---|---|---|---|
| 179,416 | 7/1876 | Kennish | 215/11.1 |
| 1,672,734 | 6/1928 | Reilly | 215/11 R |
| 2,550,568 | 4/1951 | Kersh | 220/90.2 X |
| 2,623,368 | 12/1952 | Olsen | 220/90.4 |
| 2,765,639 | 10/1956 | Bryant | 220/90.4 |
| 2,796,062 | 6/1957 | Tupper | 215/11 R |
| 2,868,203 | 1/1959 | Tichy | 215/11.4 |
| 2,876,772 | 3/1959 | Witz | 215/11.4 |
| 2,889,829 | 6/1959 | Tannenbaum et al. | 215/11 R X |
| 3,146,904 | 9/1964 | Hansen et al. | 215/11 R |
| 3,669,112 | 6/1972 | Mager et al. | 215/11 R X |
| 4,388,996 | 6/1983 | Panicci | 220/90.4 X |
| 4,600,111 | 7/1986 | Brown | 215/11 R X |

FOREIGN PATENT DOCUMENTS

| | | | |
|---|---|---|---|
| 2219909 | 3/1973 | Fed. Rep. of Germany | 215/11 R |
| 609924 | 8/1926 | France | 215/11 R |
| 1229426 | 4/1971 | United Kingdom | 220/90.4 |
| 2154451 | 9/1975 | United Kingdom | 215/11 R |
| 2029379 | 3/1980 | United Kingdom | 215/11 R |

*Primary Examiner*—Sue A. Weaver

*Attorney, Agent, or Firm*—Cushman, Darby & Cushman

[57] ABSTRACT

A child's drinking cup or bottle, with the cup or bottle having a generally rigid cap upon which there is mounted a relatively soft drinking lip or teat.

3 Claims, 9 Drawing Sheets

DRINKING CUP WITH TEAT ATTACHMENT

The present invention relates to child feeding bottles and cups, and more particularly to teats and drinking lips therefor.

Conventional baby feeding bottles employing a teat arrangement, require the teat to be brought into sealing contact with the bottle neck by means of a threaded cap. Frequently the sealing contact is not good and therefore the bottle leaks. Still further, correct insertion of the teat in the cap is not easily obtained and accordingly again resulting in leaking of the bottle.

Further to the above problems, known drinkings cups have been manufactured of a generally rigid plastics material which feels hard to the lips of the child.

It is the object of the present invention to overcome or substantially ameliorate at least one of the above disadvantages.

There is disclosed herein a cap for an infant drinking cup providing a hollow vessel to receive a liquid to be drunk and having an open top upon which the cap is mounted, said cap providing a body with an opening through which said liquid is delivered; a drinking spout or lip at least partly surrounding said opening to aid in delivery of said liquid to the mouth of the infant, and wherein the cap body is generally rigid and said spout or lip is fixed thereto and is of a softer material than the material forming said cap.

There is further disclosed herein a teat and cap assembly for an infant drinking vessel providing, a hollow body to receive a liquid to be drunk and having an open top, said assembly including a cap mounted on said top and providing a teat opening, a teat mounted on said cap and passing through said teat opening so as to project from said cap away from said vessel said cap having a sealing surface surrounding said teat opening and extending longitudinally thereof to sealingly engage said teat, and a seal member with a flange located within the teat so as to be co-extensive with respect to said sealing surface so that the teat is sealed between said surface and the flange of said seal member, and said seal member has engagement means projecting inwardly of the teat and engaging said cap to retain said teat sealingly connected to said cap.

A preferred form of the present invention will now be described by way of example with reference to the accompanying drawings, wherein.

Figure 1:
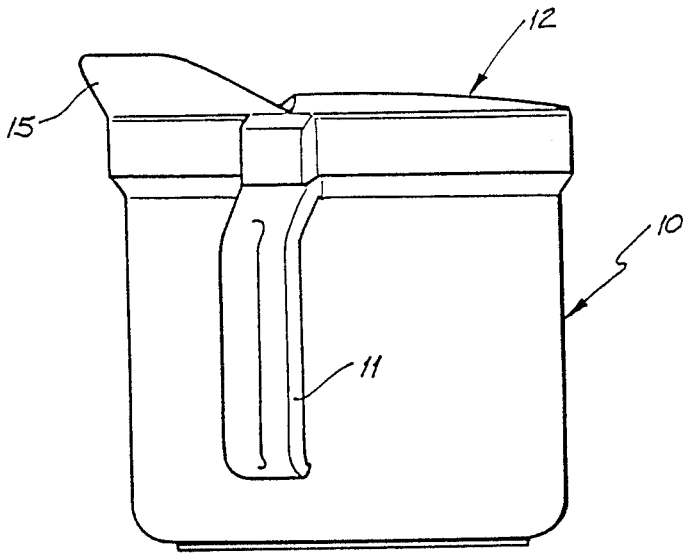
FIG. 1 is a schematic pictorial side elevation of a child's drinking cup provided with a drinking lip; .
Figure 2:
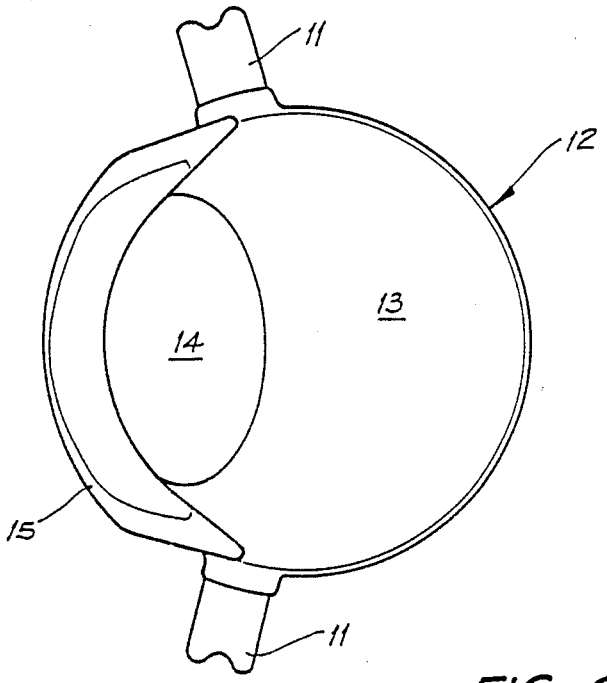
FIG. 2 is a schematic plan view of the cup of FIG. 1.
Figure 7:
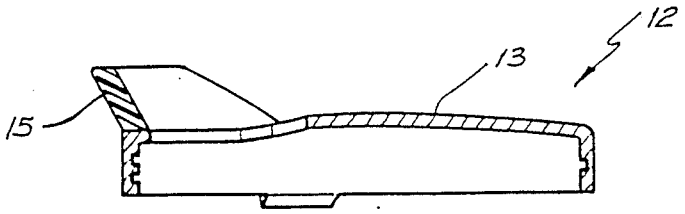
FIG. 7 is a schematic sectioned side elevation of the drinking lip and supporting cap therefor used in the cup of FIG. 1.
Figure 8:
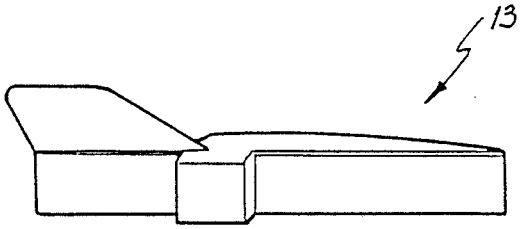
FIG. 8 is a schematic side elevation of the lip and cap of FIG. 7.
Figure 9:
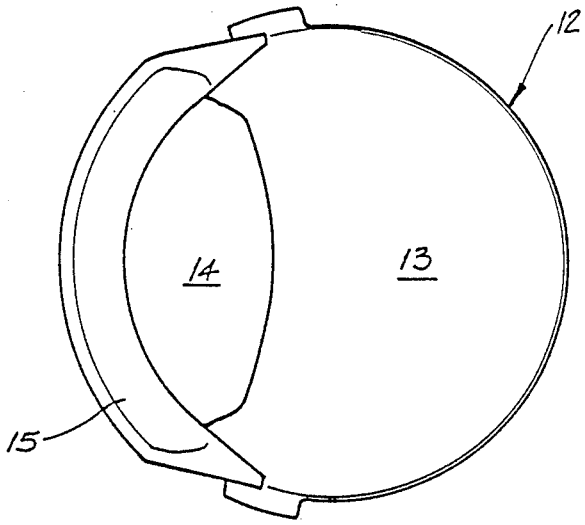
FIG. 9 is a schematic plan view of the lip and cap of FIG. 7.

In FIGS. 1 and 2 of the accompanying drawings there is schematically a child's cup 10 which is a hollow drinking vessel provided with handles 11. The handles 11 are particularly placed to make the cup 10 easily held by a child. The cup 10 is provided with a cap 12 providing an opening 14 through which a liquid is delivered. Partly surrounding the opening 14 is an arcuate drinking lip 15 which is shaped to so as to facilitate drinking from the cup 10. Preferably the body 13 of the cap 12 is formed of a generally rigid material, preferably a plastics material while the drinking lip 15 is formed of a more flexible softer material so that the lip 15 which contacts the mouth of the infant feels soft and will bend so as to conform to the shape of the child's mouth. As best seen in FIGS. 7 to 9 the lip 15 is moulded to the body 13 so as to be integral therewith or fixed thereto by an adhesive.

For example, the cup 10 could be formed of a generally rigid material such as a polycarbonate or clear acrylic or still further, polypropylene. The body 13 of the cap 12 could also be formed of the same rigid material, while the lip 15 is formed of a more soft flexible material such as silicon plastic.

Figure 3:
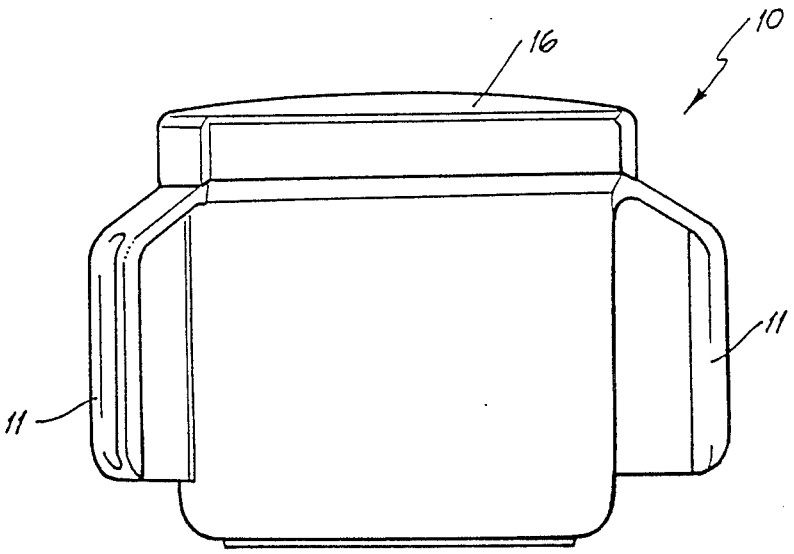
FIG. 3 is a schematic pictorial side elevation of the cup of FIG. 1 provided with a lid.
Figure 4:
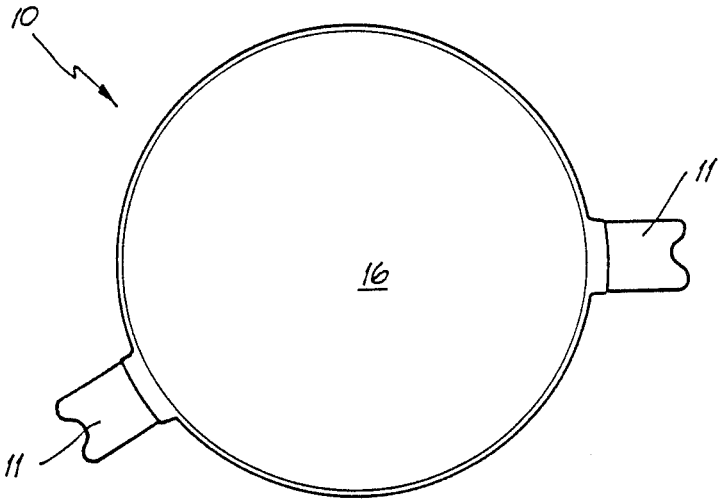
FIG. 4 is a schematic plan view of the cup as depicted in FIG. 3.
Figure 10:
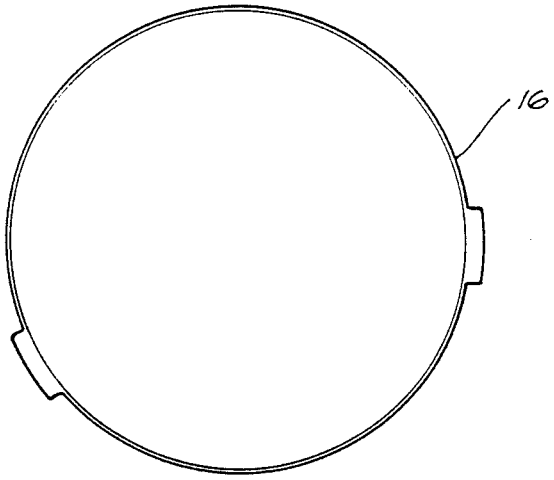
FIG. 10 is a schematic plan view of the cap employed with the cup of FIG. 3.
Figure 11:
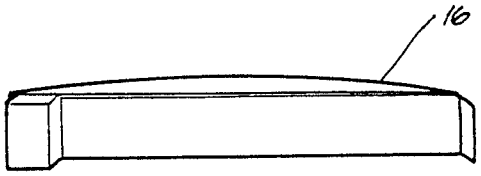
FIG. 11 is a schematic side elevation of the cap of FIG. 10.
Figure 12:
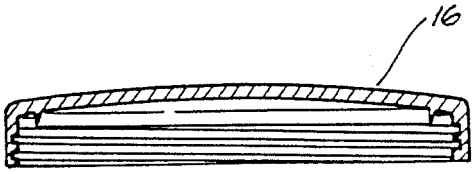
FIG. 12 is a schematic sectioned side elevation of the cap of Fig. 10.
Figure 13:
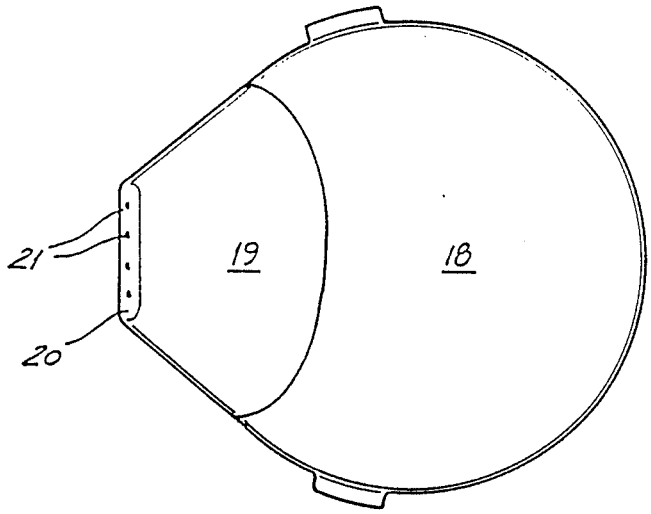
FIG. 13 is a schematic plan view of the drinking spout and cap employed in FIG. 5.
Figure 14:
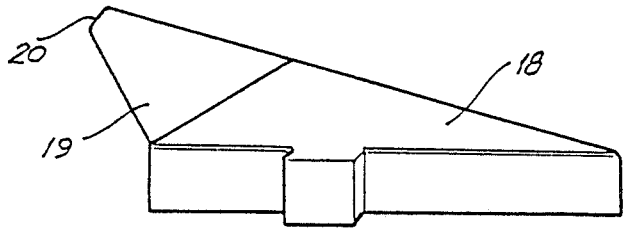
FIG. 14 is a schematic side elevation of the drinking spout and cap of FIG. 13.

In FIGS. 3 and 4 there is schematically depicted the cup 10 with a cap 16 which closes the top of the cup 10 for travelling or storage purposes. The cap 16 is further illustrated in FIGS. 10 to 12.

Figure 5:
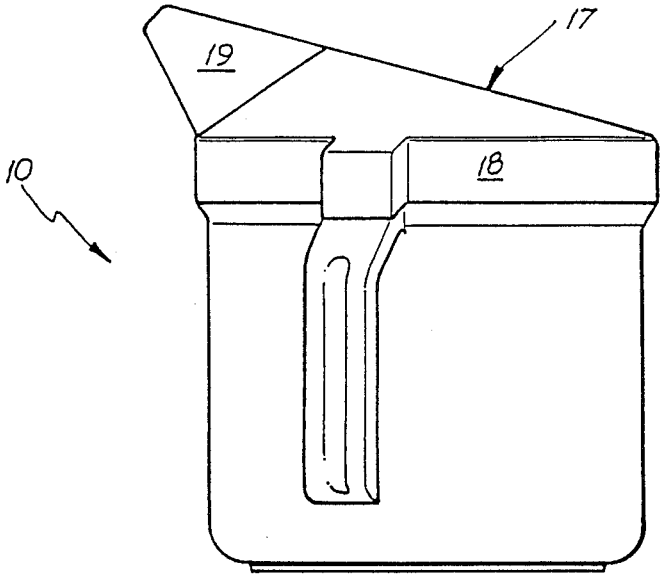
FIG. 5 is a schematic pictorial side elevation of the cup of FIG. 1 provided with a drinking spout.
Figure 6:
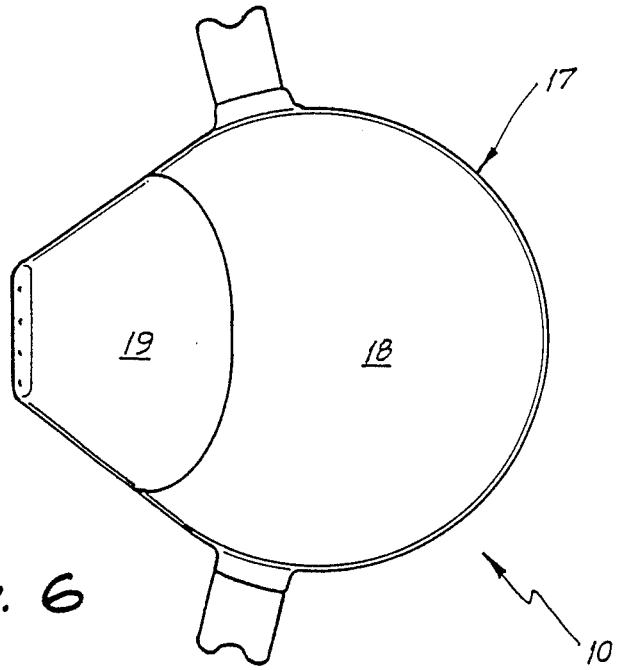
FIG. 6 is a schematic plan view of the cup of FIG. 5.
Figure 15:
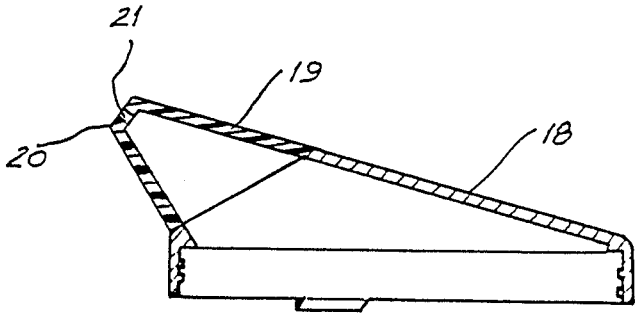
FIG. 15 is a schematic sectioned side elevation of the drinking spout and cap of FIG. 13.
Figure 16:
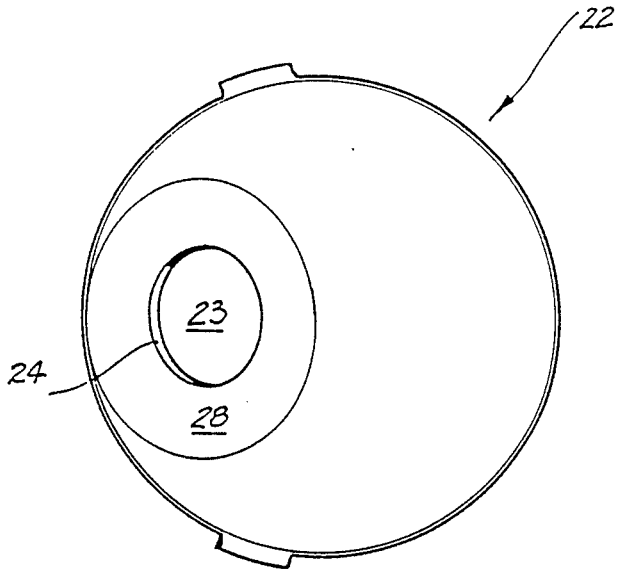
FIG. 16 is a schematic plan view of a further cap to be employed with the cup of FIG. 1.

In FIGS. 5 and 6 there is schematically depicted the cup 10 with a cap 17 consisting of a body 18 with a drinking spout 19 fixed thereto. Preferably the body 18 would be formed of a generally rigid plastics material while the spout 19 would be formed of a softer more flexible material. The spout 19 should be formed preferably of a material which can be deformed by the child's mouth and which feels soft thereto. The spout 19 would be formed of a plastics material moulded to the body 18 or fixed thereto by an adhesive. The cap 19 has an apex 20 provided with a plurality of passages 21 through which the contents of the cup may pass into the child's mouth. As best seen in FIG. 15, the cap 17 is hollow, with the hollow extending upwardly towards the apex 20.

The spout 19, could be formed of a silicon plastic in order to provide it with the soft feel and flexibility required.

Figure 17:
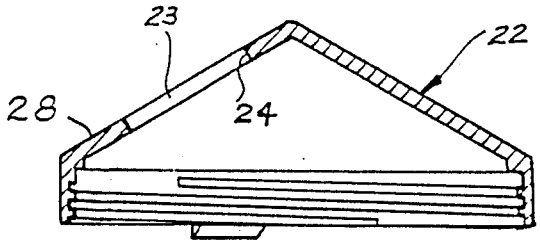
FIG. 17 is a schematic sectioned side elevation of the cap of Fig. 16.
Figure 18:
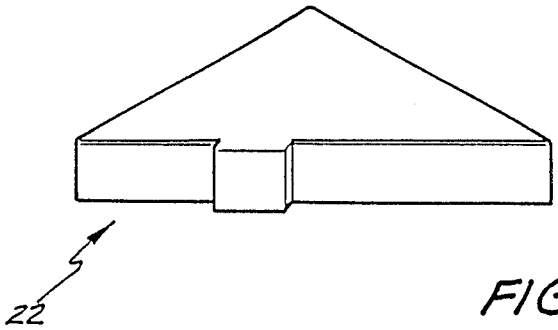
FIG. 18 is a schematic side elevation of the cap of FIG. 16.
Figure 19:
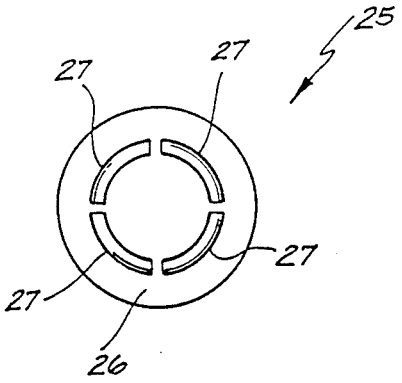
FIG. 19 is a schematic plan view of a sealing member employed with the cap of FIG. 16.
Figure 20:
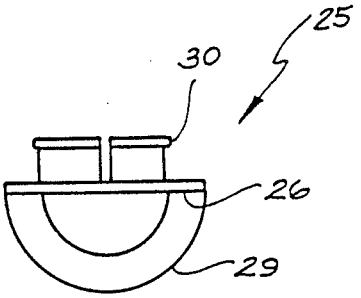
FIG. 20 is a schematic side elevation of the sealing member of Fig. 19.
Figure 21:
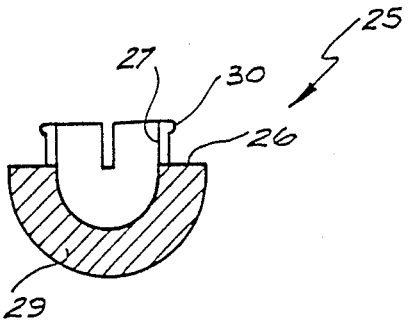
FIG. 21 is a schematic sectioned side elevation of the sealing member of FIG. 19.
Figure 22:
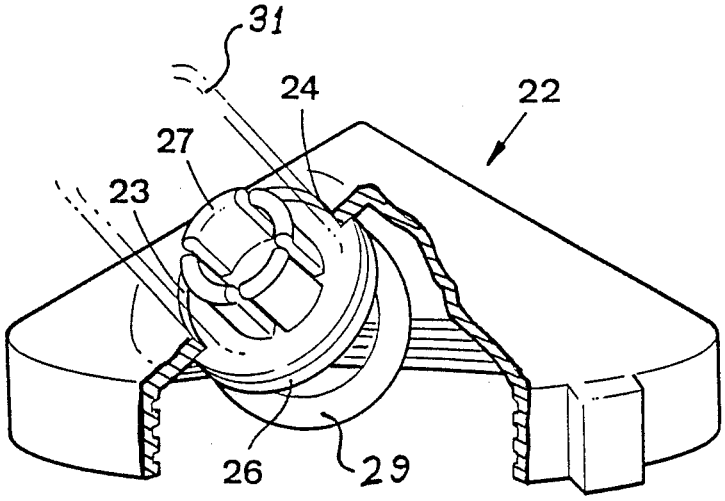
FIG. 22 is a schematic perspective view partly in cross-section of an assembly of the cap of FIGS. 16–18 and the sealing member of FIGS. 19–21.
Figure 23:
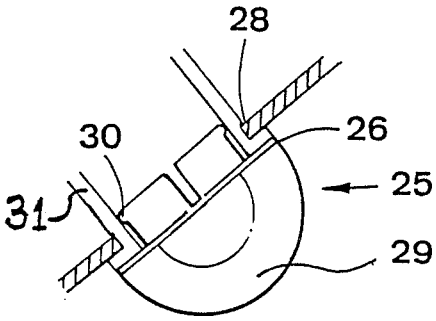
FIG. 23 is a schematic side elevation partly in cross-section of a portion of the assembly of FIG. 22.

In FIGS. 16 to 21 there is shown a cap 22 also to be mounted on the cup 10. The cap 22 is of conical configuration, as best seen in FIGS. 17 and 18, and is provided with an opening 23 through which a liquid may be delivered from within the cup 10. The passage 23, internally, is provided with a sealing surface 24 which surrounds the opening 23 and against which a teat abuts in order to sealingly contact the cap 22. Conventionally, teats are provided with a sealing flange which may be employed to contact the sealing surface 24. The opening 23 is dimensioned to allow a teat to pass therethrough so as to project from within the cap 22. To retain the teat in a position sealingly contacting the surface 24 and to retain the teat in position, there is provided a sealing member 25 illustrated in FIGS. 19 to 21. The sealing member includes a generally annular flange 26 which abuts the flange of the teat and sandwiches the teat flange against the cap 22. The sealing member 25 is further provided with resilient securing tongues 27 which generally define segments of a circle. The tongues 27 fit within the teat and project through the opening 23 so as to engage past the external peripheral surface 28 surrounding the opening 23. Each of the tongues 27 is provided with a barb 30 which projects so as to overlap the surface 28 to retain the sealing member 25 in position. Also projecting from the flange 26 is a gripping segment 29 to be gripped by a user for inserting and removing the sealing member 25. The tongues 27 are resiliently biased outward to press the teat into sealing contact with the surface 24 surrounding the opening 23. In FIGS. 22 and 23, the cap 22 depicted as receiving the sealing member 25 so as to secure a teat 31 in position.

What I claim is:

1. A teat and cap assembly for an infant drinking vessel providing, a hollow body to receive a liquid to be drunk and having an open top, said assembly including a cap to be mounted on said top and providing a teat opening, said cap having major inner and outer surfaces, a teat removably mounted on said cap and passing through said teat opening so as to project from said cap away from said vessel and to close said teat opening, said cap having a generally annular sealing surface surrounding said teat opening and extending longitudinally thereof to sealingly engage said teat, and a seal member with a generally annular flange located within the teat so as to be co-extensive with respect to said sealing surface so that the teat is sealed between said surface and the flange of said seal member, and said seal member has resiliently deformable engagement means projecting inwardly of the teat and engaging said teat to retain said teat sealingly connected to said cap but removable by deformation of said engagement means to allow removal of the teat, said engagement means including resilient fingers which project inwardly of the teat and are biased into engagement therewith, with said fingers terminating in a barb which engage past the major outer surface of the cap.

2. The cap and teat assembly of claim 1 wherein said seal member includes a gripping segment to aid a user in inserting and removing the seal member.

3. An infant drinking vessel including a hollow body to receive a liquid to be drunk and having an open top, and a teat and cap assembly including:

a cap mounted to said top and providing a teat opening, said cap having major inner and outer surfaces;

a teat removably mounted on said cap and passing through said teat opening so as to project from said cap away from said hollow body and to close said teat opening, said cap having a generally annular sealing surface surrounding said teat opening and extending longitudinally thereof to sealingly engage said teat; and a seal member with a generally annular flange located within the teat so as to be coextensive with respect to said sealing surface so that the teat is sealed between said sealing surface and the flange of said member, said seal member having a gripping portion projecting internally of the cap and including a gripping segment to aid a user in inserting and removing the seal member, and said seal member having a resiliently deformable engagement means including resilient fingers which project inwardly of the teat and are biased into engagement therewith to retain said teat sealingly connected to said cap but removable by a deformation of said engagement means to allow removal of the teat, said resilient fingers of said engagement means terminating in a barb which engage past the major outer surface of the cap.

* * * * *